US006004160A

United States Patent [19]

Korsunsky et al.

[11] Patent Number: 6,004,160

[45] Date of Patent: Dec. 21, 1999

[54] ELECTRICAL CONNECTOR WITH INSERT MOLDED HOUSING

[75] Inventors: Iosif Korsunsky, Harrisburg; Alexander William Hasircoglu, Columbia; David Miller, Dallastown; Richard Schroepfer, Thompsontown, all of Pa.

[73] Assignee: The Whitaker Corporation, Wilmington, Del.

[21] Appl. No.: 08/823,502

[22] Filed: Mar. 25, 1997

[51] Int. Cl.[6] ..... H01R 17/00

[52] U.S. Cl. ..... 439/660; 439/736

[58] Field of Search ..... 439/660, 736, 439/924.1, 722, 607, 95, 108

[56] References Cited

U.S. PATENT DOCUMENTS

| | | | |
|---|---|---|---|
| 3,126,242 | 3/1964 | Herman | 439/736 |
| 3,391,456 | 7/1968 | Gannoe | 29/625 |
| 4,392,705 | 7/1983 | Andrews, Jr. et al. | 439/660 |
| 4,566,750 | 1/1986 | Umezu | 339/126 R |
| 4,749,372 | 6/1988 | Betsui | 439/587 |
| 4,865,562 | 9/1989 | Burg et al. | 439/395 |
| 4,870,753 | 10/1989 | Pfeffer et al. | 29/884 |
| 5,017,164 | 5/1991 | Gibbs | 439/885 |
| 5,038,468 | 8/1991 | Wanatowicz | 29/882 |
| 5,176,541 | 1/1993 | Mori | 439/736 |
| 5,184,963 | 2/1993 | Ishikawa | 439/79 |
| 5,201,883 | 4/1993 | Atoh et al. | 29/883 |
| 5,236,375 | 8/1993 | Kachlic | 439/607 |
| 5,448,824 | 9/1995 | Groves | 29/827 |
| 5,456,618 | 10/1995 | Nakamura | 439/607 |
| 5,762,525 | 6/1998 | Candeloro | 439/660 |
| 5,772,474 | 6/1998 | Yagi et al. | 439/736 |
| 5,779,505 | 7/1998 | Yagi et al. | 439/736 |
| 5,795,194 | 8/1998 | Hahn | 439/660 |

FOREIGN PATENT DOCUMENTS

| | | | |
|---|---|---|---|
| 0735617 A1 | 2/1996 | European Pat. Off. | H01R 13/26 |
| 405062733 | 3/1993 | Japan | 439/736 |
| 2094569 | 9/1982 | United Kingdom | 439/736 |

OTHER PUBLICATIONS

PCT Internationl Patent Application; WO97/40551, Oct. 30, 1997.

*Primary Examiner*—Paula Bradley
*Assistant Examiner*—Tho Dac Ta
*Attorney, Agent, or Firm*—Katherine A. Nelson; Robert W. Pitts

[57] ABSTRACT

An electrical connector 2, suitable for use as a plug for a Universal Serial Bus cable assembly, includes a plurality of terminals 4 that are partially insert molded in a nonconductive housing 36. A distal end 6 of each terminal 4 is recessed from the front end 38 of the housing 36. The terminals 4 are insert molded while still on a carrier and a weakened section 14 is formed at the distal end 6. After the housing 36 is molded, a tensile force is applied to fracture each terminal 4 at the weakened section 14 so that the distal end 6 of each terminal is recessed where it cannot inadvertently contact shields 54, 64 on the plug 2 or a mating receptacle 62. The rear of the housing is overmolded, and the insert molded housing 36 includes sections completely surrounding the terminals 4 so that the overmolded material cannot flow onto a housing mating surface 42 or onto a terminal mating section 10.

18 Claims, 6 Drawing Sheets

FIG. 8
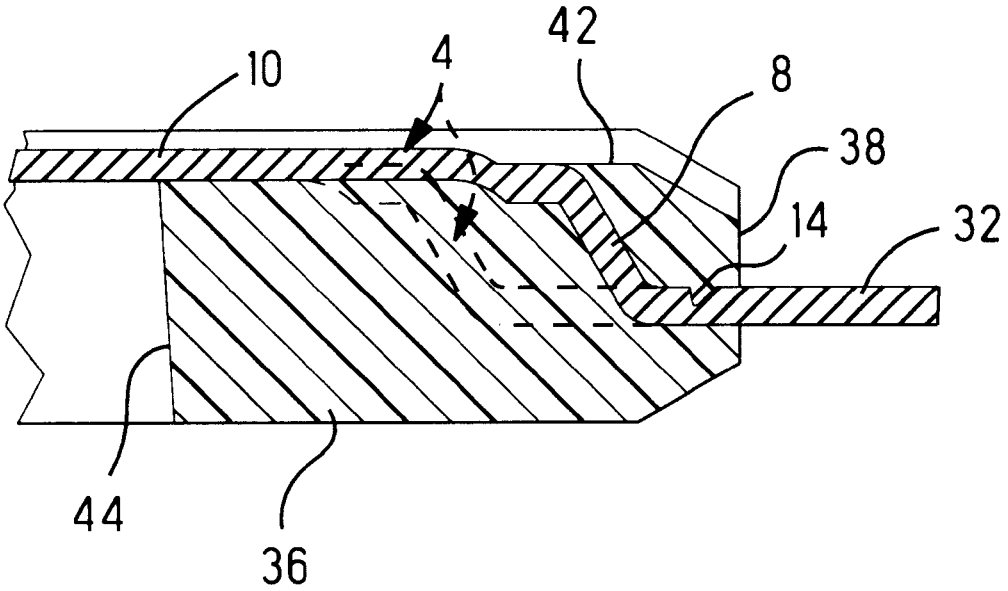
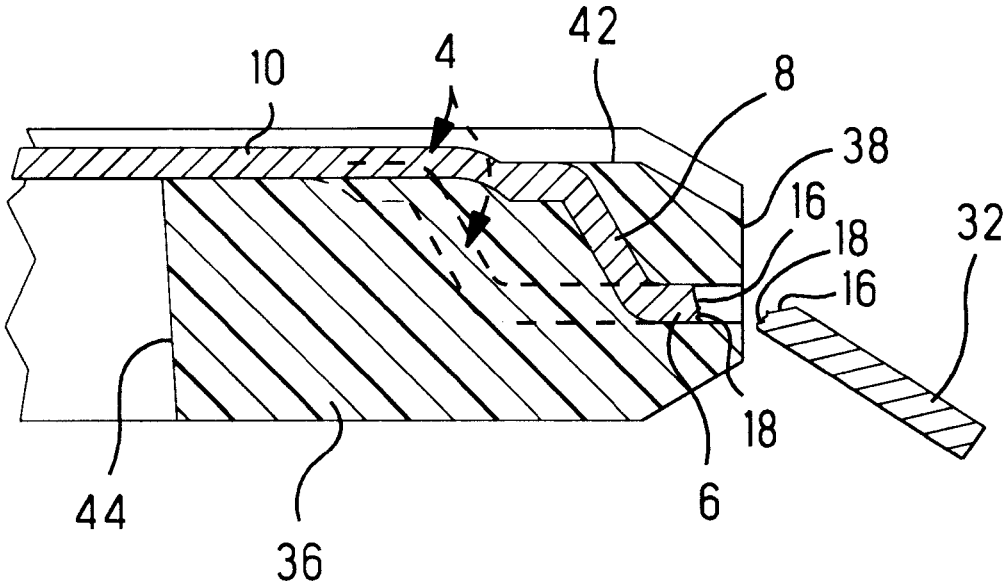
FIG. 9

ELECTRICAL CONNECTOR WITH INSERT MOLDED HOUSING

FIELD OF THE INVENTION

This invention is related to electrical connectors and more particularly to electrical connector plug that can be used on the ends of a cable assembly. For example, this invention is related to a Universal Serial Bus plug that can be used with computer peripherals. This invention is also related to insert molded electrical connectors and to the method of insert molding electrical terminals in a molded housing.

BACKGROUND OF THE INVENTION

Perhaps the most common method of positioning multiple contact terminals in the nonconductive housing of an electrical connector is to employ snap latches on the terminals to engage surfaces on contact receiving channels in the connector housing. For many applications, this approach is quite satisfactory and mass assembly apparatus for economically loading snap latch terminals in housings are commonly used.

In some applications, however, the snap latch features on both the terminals and the nonconductive housings do pose problems. For example, the snap retention features do require space and for connectors having a closely spaced terminals, the retention geometry can become a problem. The snap retention features also leave open passages between the front and back of a connector. These open passages must be sealed for certain applications. For example, a sealed connector can require the use of separate seals for each terminal passage or cavity.

Another application in which the open passages required by retention features can pose problems is the use of secondary molding operations to fabricate the final product. One common example of a secondary molding operation is an overmolded connector in which a material, such as PVC, is molded over the connector and the end of a cable attached to the connector after the cable wires are terminated to the connector or plug. Cable assemblies of this type are commonly used for computer peripherals. If the terminals cavities remain open, due to the presence of the snap latch retention features on the terminals and the housing, the overmolding material can flow through these passages and foul or contaminate the mating surfaces on the terminals and the nonconductive housing. One approach for preventing the overmolding plastic from entering the mating side of an electrical connector is to employ two molding operations. The first overmolding step is a low pressure injection molding operation in which the overmolding plastic is injected into the terminal cavities at a pressure that is small enough to prevent plastic from reaching the mating side of the connector. The overmolded material is then allowed to solidify, and a second higher pressure overmolding step is used to form the final configuration. However, this two step procedure adds time and expense to the manufacturing operation.

Another technique that can be used to overcome the problems associated with snap latch geometry is to insert mold terminals in a nonconductive housing. The material forming the nonconductive housing flows around the terminals so that the rear of a connector can be completely isolated from the mating side of the connector. Two examples in which a plurality of terminals are molded in a nonconductive connector housing are shown in U.S. Pat. No. 4,865,562 and U.S. Pat. No. 5,184,963. This latter patent describes how contact terminals are maintained on desired center to center spacing on carriers and the housing is then molded around the terminals. After insert molding the contacts, including the carriers, are bent so that reliefs at opposite ends of the contacts allow removal of the carriers by either cutting or bending so that the contact material breaks off between the ends of the contacts and the associated carriers. However, the ends of these contacts extend well beyond the insert molded housing.

In some applications, contacts or leads must be cut adjacent to the housing. This requires an additional die cutting step with an attendant manufacturing cost. U.S. Pat. No. 5,236,375 shows a connector in which carriers are cut immediately adjacent to an insert molded housing. U.S. Pat. No. 5,038,468 discloses another approach in which carriers or connecting ties are cut in the mold itself by using a three piece mold with a punch that severs the carriers upon initial closing of the mold. The final connector housing includes openings formed by the punches. This approach, however adds additional complication to the mold tooling and conventional molds could not be used.

None of these approaches permits the removal of an external carrier strip after an nonconductive housing has been insert molded around the terminals without the use of additional die cutting tooling in applications in which substantial portions of the terminals do not extend well beyond the housing. None of these approaches permits manufacture of a connector in which the ends of terminals are recessed from the end of the housing and are not flush or exposed where they cannot come into contact with other conductive surfaces, such as external shields, during mating and unmating. Furthermore these approaches are not compatible with the use of conventional molds for insert molding the connector.

SUMMARY OF THE INVENTION

The present invention provides a practical means of fabricating an insert molded electrical connector in which the mating ends of terminals are recessed relative to the front or mating end of the electrical connector. The use of die cutters to sever the terminals from carriers is also eliminated. The terminals for connector plugs are stamped and formed on a continuous carrier. A weakened section is formed where the mating end of these terminals joins transverse carriers. Preferably, this weakened section is formed by coining or an equivalent mechanical operation that can be incorporated into a high speed progressive die. A nonconductive housing is then insert molded around the terminals with mating sections and termination sections of the connector remaining exposed. The weakened section of the terminals is however recessed relative to the mating end of the housing and is not flush with the end of the housing. A tensile force can then be applied to remove a transverse carrier with the terminal fracturing at the recessed weakened section. The distal end is therefore spaced from any other conductive surface, such as an external shield and inadvertent contact, especially during mating and unmating is not possible. After the housing is first molded with the terminals being insert molded in this housing, positions of the connector can be overmolded. The insert molded housing will prevent the overmolding material from entering the mating part of the terminals and the housing. This invention is especially adapted to the fabrication of plug cable assemblies, such as a Universal Serial Bus plug cable assembly.

An embodiment of the invention will now be described by way of example with reference to the following drawings.

BRIEF DESCRIPTION OF THE DRAWINGS

FIG. 8 is a side section view of the forward end of a Universal Serial Bus connector prior to separation of the terminals form a transverse strip showing the weakened section.

FIG. 9 is a view similar to FIG. 8 after the terminal is severed from the strip.

DETAILED DESCRIPTION

Figure 1:
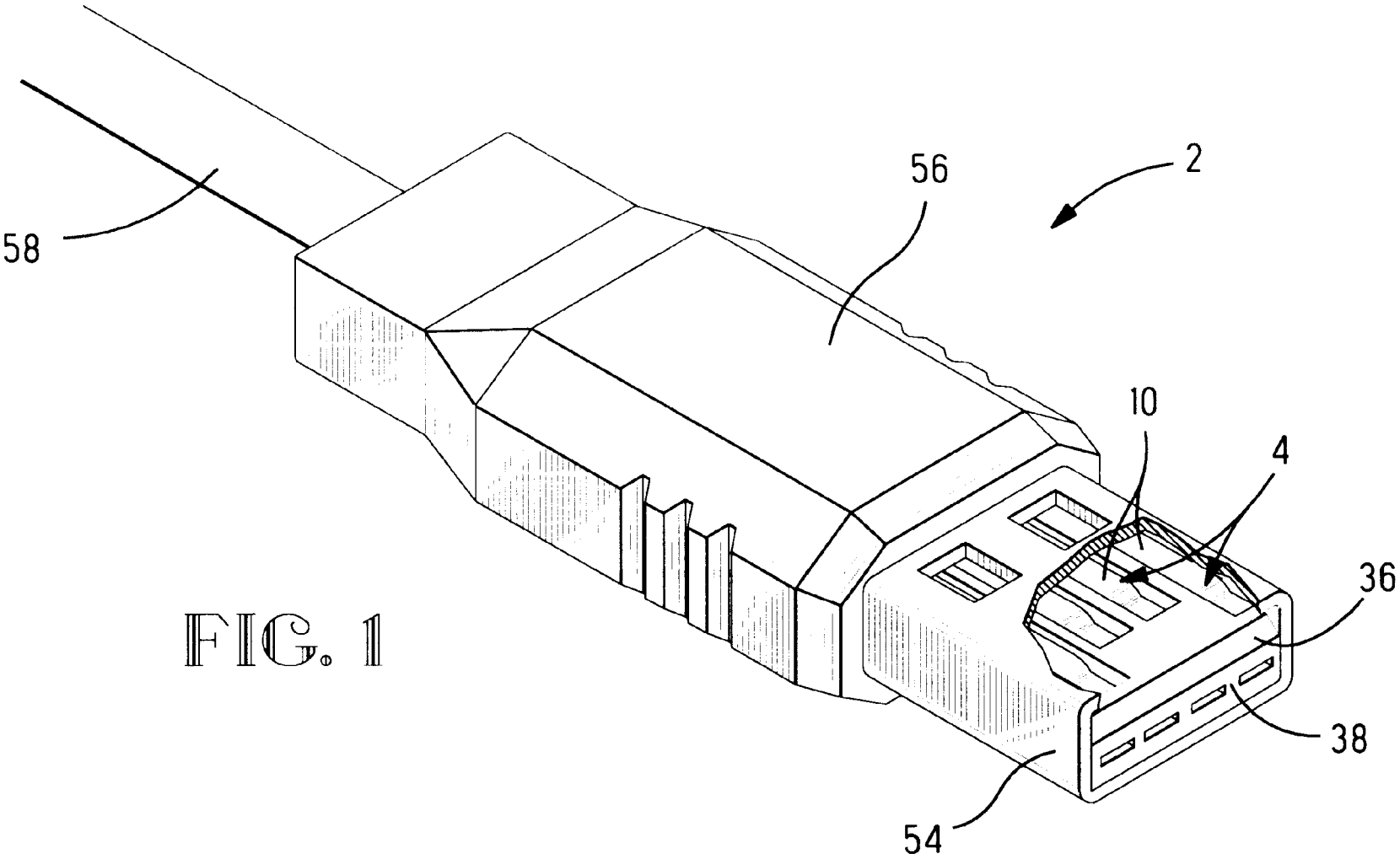
FIG. 1 is a three dimensional view of the preferred embodiment of a Universal Serial Bus plug as seen from above.
Figure 2:
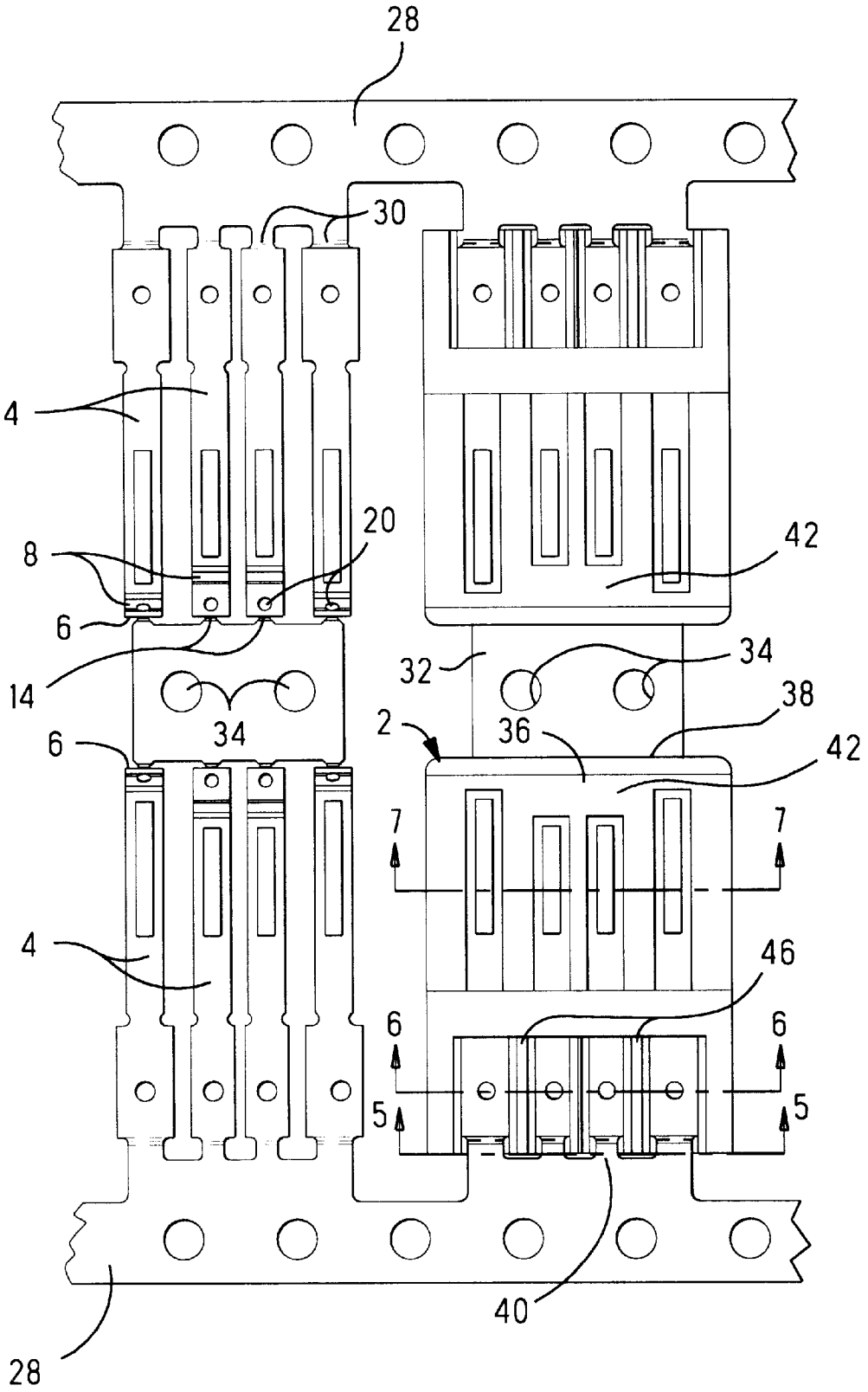
FIG. 2 is a view showing the manner in which terminals on carrier strips are insert molded to form individual plug connectors.

FIG. 2 shows the two principal stages in the fabrication of the electrical connector or Universal Serial Bus plug 2, shown in FIG. 1. The terminals 4 in plug 2 are stamped and formed on a continuous strip in identical segments. One segment of that strip is shown on the left in FIG. 2. In the preferred embodiment, this continuous strip is double ended with terminals 4 joined at opposite ends to carriers 28 and with a central transverse strip 32 joining the four terminals 4 of a single electrical connector plug 2. The double ended segment on the left in FIG. 2 is shown just prior to entry into a mold in which the terminals 4 will be insert molded in a nonconductive housing 36.

Each of the terminals 4 extend from a distal or forward end 6 to a termination section 12. As shown in FIG. 2, the distal end 6 of each terminal 4 is connected to the central transverse strip 32. The opposite or rearward end of each terminal is joined to a carrier strip 28 adjacent to the termination section. A mating terminal section 10 is located between the termination section 12 and the distal end 6. An intermediate terminal section 8 joins the mating section 10 of each terminal 4 to the distal end section 6.

In the preferred embodiment of this invention the terminals 4 can be stamped from an electrically conductive metal such as brass. The mating section 10 can be plated with a noble metal plating, such as gold over nickel, to insure a reliable electrical interface with a resilient contact in a mating electrical device or receptacle connector. In this preferred embodiment a wire is to be soldered to each termination section 12 when the plug 2 is attached to a cable, and a tin-lead plating is used on the termination section 12.

The distal end 6 of each terminal 4 is joined to the transverse strip 32 by a weakened section 14. In the preferred embodiment this weakened section 14 has been reduced in width, as shown by the tapered edges 21 in FIG. 12, and formed by coining the terminal blank at this point. This coining operation reduces the thickness of the terminal 4 and work hardens it at the location of the distal end and forms a V-shaped groove with smooth coined surfaces. This weakened section 14 can also be formed by other mechanical stamping, forming or working operations. For example, the terminal can be partially slit in this area to reduce the width of the material joining the distal end 6 to the transverse strip 32. Any operation that insures that the terminal will fail at this location when subjected to a tensile load would be suitable for forming this weakened section 14, provided that that operation is compatible with high speed stamping and forming operations preferably in a progressive die.

The opposite end of the terminal adjacent to the termination section 12 is also joined to the adjacent carrier strip 28 by a weakened section 30. This weakened section 30 can be coined, slit or otherwise fabricated to reduce the force necessary to remove the carrier strip 28 from the terminals 4 after the terminals 4 have been insert molded in a nonconductive housing 36. The carrier strip 28 can be removed by applying a tensile force or by bending the carrier strip 28 relative to the terminals 4. The weakened section 30 is not as critical as the distal end weakened section 14, and this electrical connector can be fabricated by shearing the carrier strip 28 from the terminals 4 at the rear 40 of the housing 36 in a conventional manner. However, the addition of the carrier strip weakened section 30 does make it possible to remove the carrier strip without the use of cutting tooling.

The station shown on the right of FIG. 2 is the insert molding station. To insert mold the terminals 4 into a nonconductive housing 36, the terminal strip is placed in a mold cavity. FIG. 2 shows this insert molding operation in a representative manner showing only one station, that is two connectors for the double ended terminal strip. In actual practice a multicavity mold would be employed and terminals for a number of separate connectors would be simultaneously insert molded in housings in a multiple cavities. The nonconductive housing 36 is molded around portions of the terminals 4 in a single array of four terminals. Mold sections, not shown, close around the terminals and plastic is injection molded. In the preferred embodiment, a conventional plastic, such as a liquid crystal polymer, suitable for injection molding or insert molding is employed. This thermoplastic is injected under pressure into the cavity in a molten, or viscous flowing state. The flowing thermoplastic flows around the terminals 4 in open portions of the molding cavities and fills the cavity. It should be understood that the thermoplastic is viscous and is injected under pressure. After the thermoplastic cools, it surrounds portions of each terminal 4. Each terminal 4 will then be securely held within the nonconductive housing 36 with portions of each terminal being exposed along exterior surfaces of the housing. Tabs, lances or protruding retention features, that require space and a separate assembly operation, are therefore eliminated.

Figure 6:
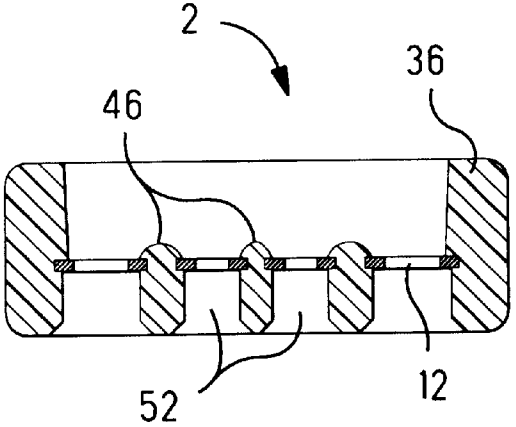
FIG. 6 is a view taken along section 6—6 in FIG. 2.

The plastic will completely enclose several sections of each terminal. The intermediate section 8, which extends transversely between the distal end section 6 and the mating section 10 will be completely enclosed in the plastic. The distal end section 6 which extends generally parallel to the mating section 10 will also be enclosed on all sides by the plastic which will flow through a hole 20 to provide additional stability for this distal end and will form a plastic rivet at this section. The plastic will also surround the weakened section 14 while it remains intact and the terminals 4 are still connected to the transverse strip 32. The weakened section 14 will thus be recessed from the front end 38 on the insert molded nonconductive housing 36. Plastic will also completely surround the terminal 4 between the mating section 10 and the termination section 12 in a central insert molded section 48. The mating section 10 extends along an exterior housing mating surface 42 and the plated top surface of the terminal mating section 10 is exposed for establishing an interface or contact surface with a mating terminal. As shown in FIGS. 2, 4 and 6, housing ribs 46 are molded between adjacent termination sections 12 and the top of each termination section 12 is exposed to be accessible for soldering. Oval openings 52 with plastic filling in the space surrounding the termination sections 12 are formed on the opposite surface of the housing as shown in FIG. 3.

Figure 3:
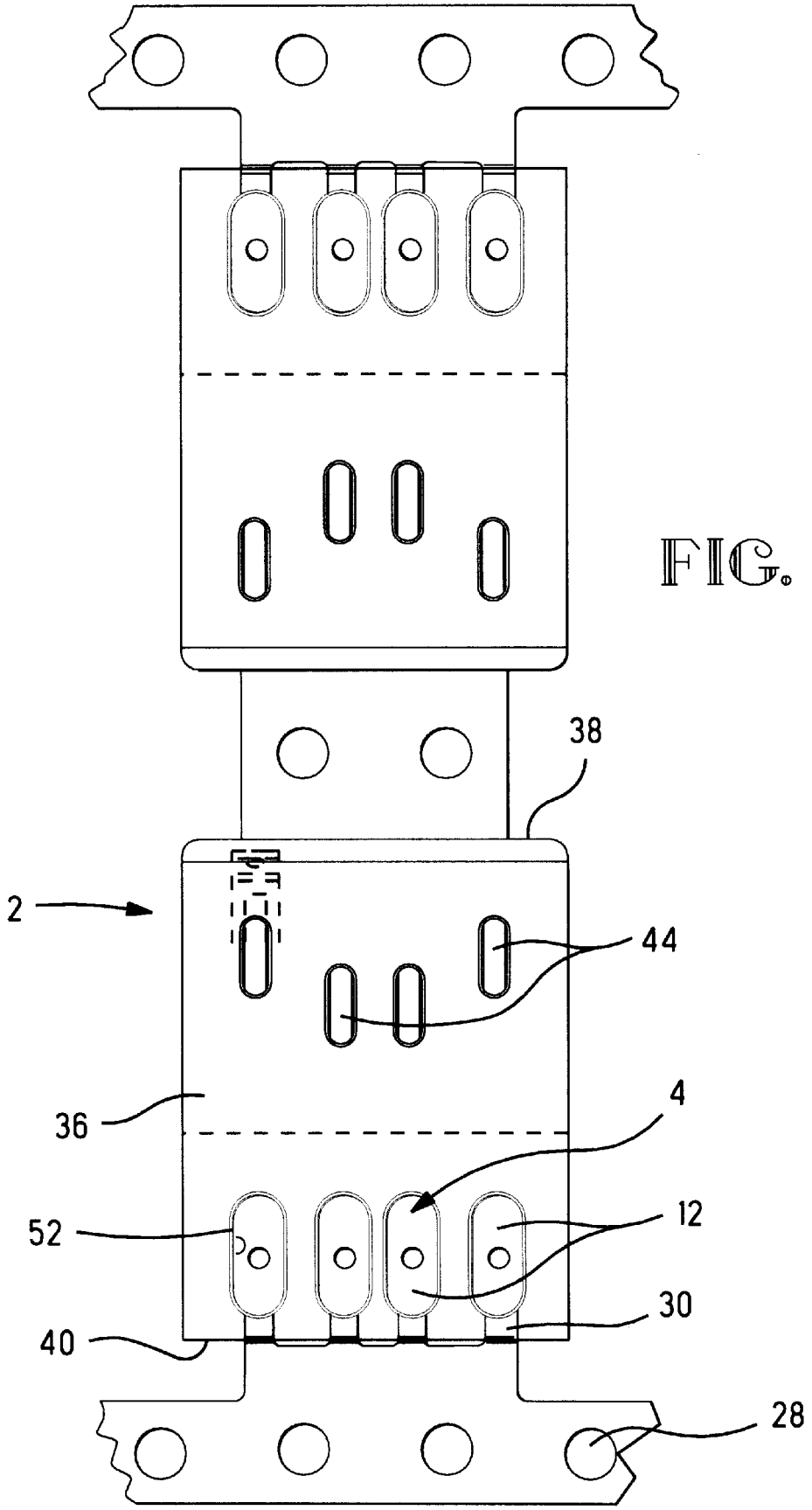
FIG. 3 is a bottom view of a Universal Serial Bus connector, with the terminals in two connectors still connected to carriers.
Figure 4:
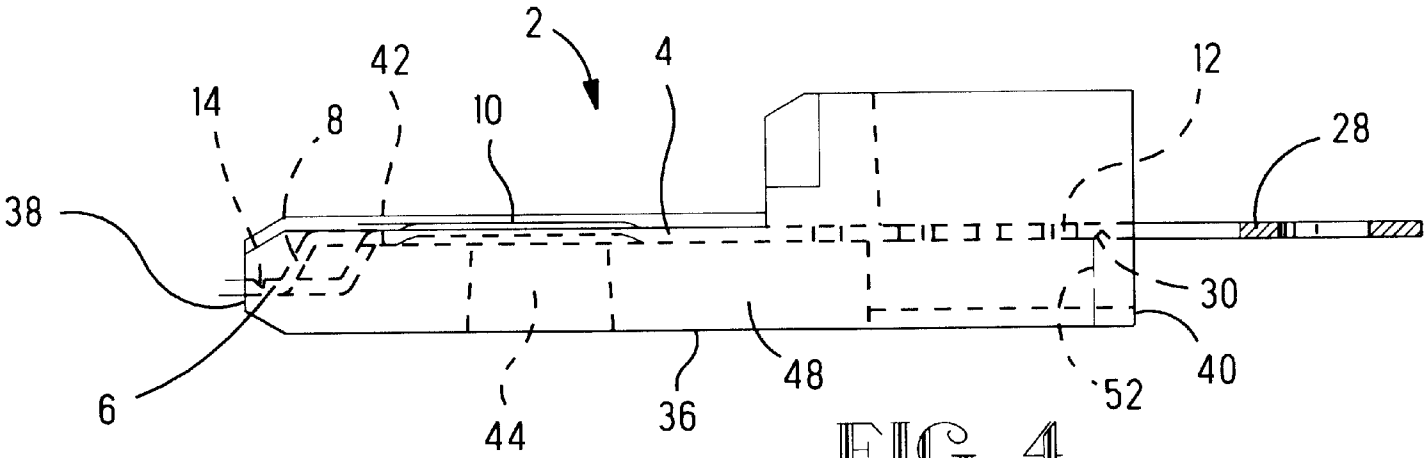
FIG. 4 is a side view of the Universal Serial Bus connector prior to removal from a carrier strip.
Figure 5:
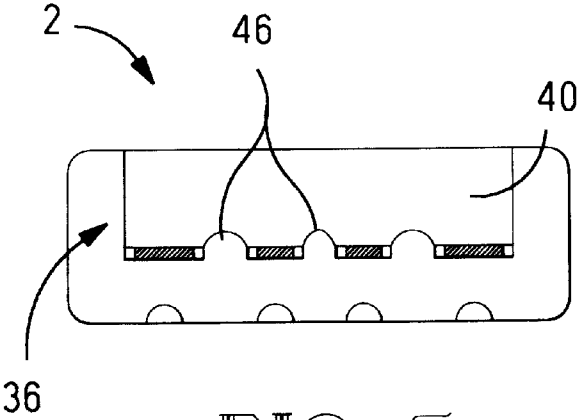
FIG. 5 is a view taken along section 5—5 in FIG. 2.

FIG. 3 shows the connector bottom surface opposite to the connector top surface shown in FIG. 2. The termination section 12 of each terminal is exposed on the bottom surface as shown in FIG. 6, and as shown in FIG. 5. Core pin openings 44 extend from the bottom surface in alignment with each terminal 4 and during the insert molding operation a core pin, not shown, will extend through each opening 44 and will engage the bottom surface of the mating section 10 of each terminal 4 assuring containment of the mating section 10 during molding as required to eliminate plastic from flashing on the mating surfaces.

Figure 7:
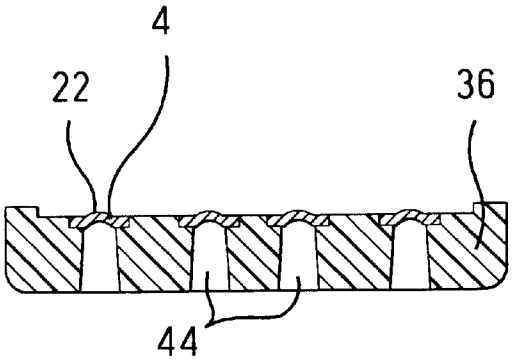
FIG. 7 is a view taken along section 7—7 in FIG. 2.
Figure 10:
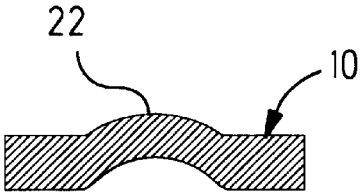
FIG. 10 is a section view showing the preferred embodiment of a radiused ridge on the mating section of the terminal.
Figure 11:
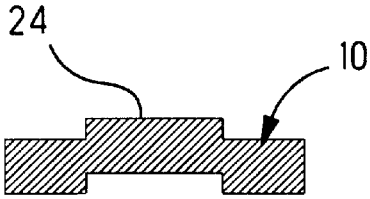
FIG. 11 is a section view similar to FIG. 10 showing an alternative configuration in which the ridge on the mating section of the terminal is stepped instead of radiused.

FIG. 4 is a side view of a plug connector 2 prior to removal of the carrier strip 28 and the transverse strip 32. The weakened sections 14 and 30 are shown. FIG. 4 shows that the distal weakened section 14 is recessed from the front housing end 38 and plastic has flowed around a portion of the transverse strip 32 adjacent to the weakened section 14. The carrier notch 30 is also recessed. FIG. 4 also shows that the intermediate terminal section 8 extends at an angle between the parallel planes in which the distal end section 6 and the mating section 10 are located. For the Type A Universal Serial Bus plug 2 shown in the preferred embodiment of this invention, the mating section 10 of the two outermost terminals is longer than the mating section 10 of the two innermost terminals, so that the outer terminals will make first and break last, and corresponding intermediate sections 10 are therefore offset. As shown in FIGS. 7 and 10 this portion of the mating section 10 is formed as a radiused contact ridge 22. This ridge 22 provides for a cross cylinder interface for reliable low resistance contact interfaces. Wiping effectiveness is enhanced with the raised portion 22. FIG. 11 shows an alternative version in which a stepped contact ridge 24 is used instead of the radiused contact ridge 22.

FIGS. 8 and 9 shown the front housing end 38 and the plastic surrounding the intermediate section 8 and the distal end section 6 of a terminal 4. As shown in FIG. 8 plastic fills the V-groove formed where the weakened section 14 is coined. When the transverse strip 32 is removed by applying a tensile force to rupture the weakened section 14, a smooth mechanically formed or worked section 16 is left on the terminal distal end 6 along with a jagged fractured section 18 having the contour of a tensile fracture. The distal end 6 is however recessed from the front end 38, and the terminal distal end 6 will not be exposed during mating or unmating.

Figure 12:
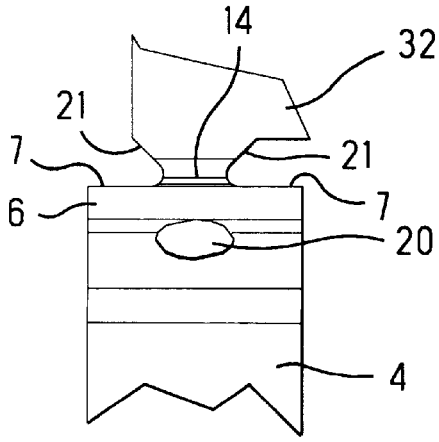
FIG. 12 is an enlarged view of the weakened section at the distal end of each terminal prior to separation of the terminals from the transverse strip. The tapered connection between the distal end of the terminal and the transverse strip is shown.

The transverse strip 32 can be disconnected from the terminals 4 in the individual connectors 2 by applying a tensile force. In a manufacturing environment the strip 32 would be removed by simple tooling which could include a means for engaging the registration hole 34 and then applying an axial force to fracture the weakened section 14. FIG. 12 shows that the width of the material joining strip 32 to the terminal 4 is reduced as tapered edges extend from the strip 32 to the weakened section 14. This taper means that the material is angled away from the eventual break area at weakened section 14 so that the strip 32 will release from the material insert molded around both the distal end 6 and this portion joining the terminal 4 to the strip 32. This means that there is less retention between the plastic housing and the strip material to be removed and there will be less friction. By tapering the section and by providing a blunt edge 7 on the distal end 6 as well as the plastic rivet extending through hole 20, a more reliable break point can be defined. The strip 32 could be removed immediately after insert molding, but more typically the individual connectors 2 would remain intact on the carrier strips 28 and the entire strip would be reeled for later use. Wires in cables 58 could be soldered to the termination sections while the terminals remain attached to the carrier strips 28 at one or both ends of the reeled strip. The transverse strip 32 would remain intact for a double ended reel or would be severed prior to reeling the strip for a single ended reel.

The next step in the fabrication of a connector, such as the Universal Serial Bus plug 2 would be the addition of a shield 54. The shield 54 would typically comprise a stamped and formed member and the plug 2 is inserted in the shield 54. The mating surface 42 and the terminal mating sections 10 would remain exposed and would not be covered by the shield. Since the distal ends 6 of each terminal is recessed relative the front end 38 of each plug 2, these distal ends 6 cannot come into contact with the shield and would remain spaced from a ground plane to avoid any changes or local discontinuities in the impedance of the signal paths.

After wires are attached to the termination sections 12 of each terminal 4 and the cable braid, not shown, is crimped to the shield 54 , the cable will be overmolded around a portion of each connector 2 to form a cable assembly. The ends of a jacket surrounding the cable 58 will have been removed to expose the individual wires for termination. At this point the assembly of terminated plugs or individual terminated plugs would be placed in a second mold to form an overmolded section 56 surrounding the end of the cable jacket, the terminated wires and the solder termination and the rear portion of the plug 2. PVC is injected into this second mold to form the overmolded section 56. Since the original housing was insert molded over the terminals 4 there are no internal channels or housing clearance openings for terminal lances. The housing plastic completely surrounds the terminals 4 between the termination section 12, which is overmolded, and the mating section 10 which must remain exposed. The overmolded section 56 can therefore be formed in one molding operation. A first lower pressure overmolding operation in which the pressure is insufficient to force the PVC material through clearance openings to be followed by a higher pressure overmolding operation is not necessary because insert molded housing completely blocks any PVC material. There is no path through which the PVC can migrate to contaminate the mating sections 10 of the terminals. If the transverse strip 32 has not been previously removed, it can be removed by applying a tensile load, fracturing the weakened section 14, after completion of the overmolding step.

Figure 13:
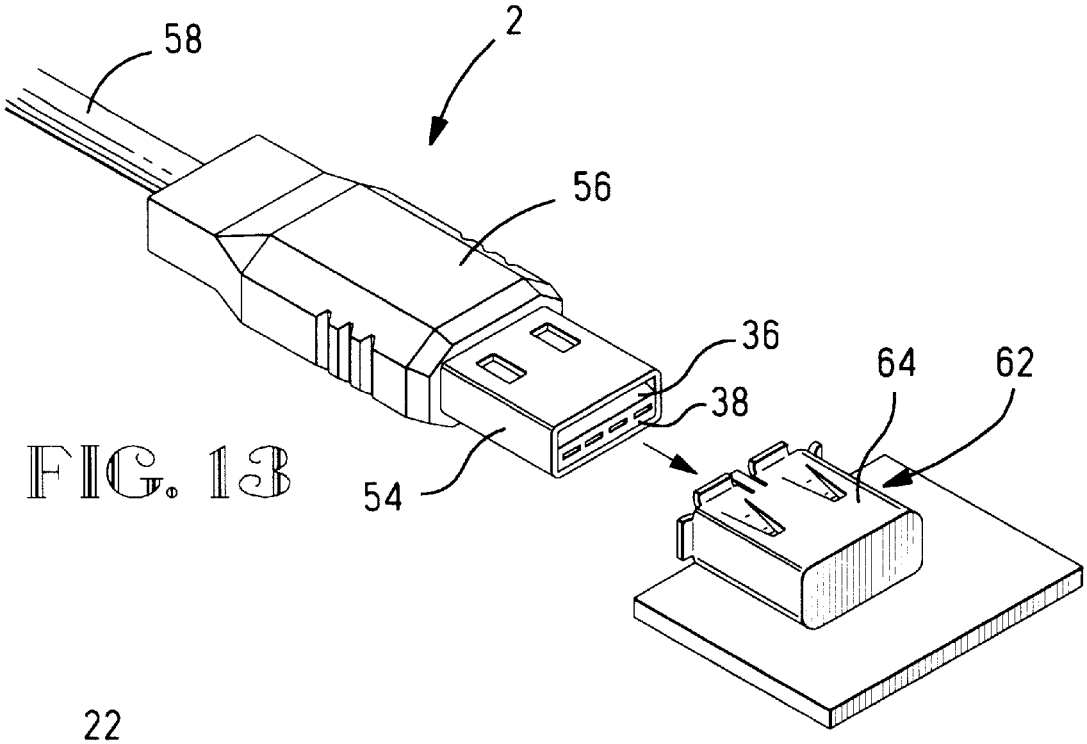
FIG. 13 is a view of a Universal Serial Bus cable assembly with an overmolded plug connector located at one end of a cable and a mating shielded receptacle connector to which the shielded Universal Serial Bus plug connector is mated.

FIG. 13 shows how a Universal Serial plug 2 is mated with a mating device such as a receptacle connector 62 mounted on a printed circuit board. Resilient contacts in the receptacle connector, not show, engage the exposed terminal mating sections 10 and the connector shield 64 engages the plug shield 54.

The representative embodiment depicted and described herein is a Type A Universal Serial Bus plug. It should be understood that a Type B Universal Serial Bus plug could also have been chosen as the representative embodiment. Furthermore, this invention is suitable for use with numerous other connector configurations and a number of connector configurations could be insert molded pursuant to the invention described herein and the subject of the following claims.

We claim:

1. An electrical connector matable with a mating device, the electrical connector comprising:

a molded nonconductive housing having a forward end; and at least one electrically conductive terminal extending toward the forward end of the housing, and including a mating section on one external surface of the molded nonconductive housing, and having a distal end recessed from the forward end of the housing so that the distal end is not exposed to the mating device when the electrical connector is mated to the mating device;

the electrical connector being characterized in that at least the distant end of the terminal is insert molded in the molded nonconductive housing.

2. The electrical connector of claim 1 wherein the molded housing is formed of a plastic material, the plastic material being molded around each surface of the terminal, at the distal end, extending transverse to the forward end of the housing.

3. The electrical connector of claim 2 wherein each terminal includes a mating section extending substantially perpendicular to the forward end of the housing, in an exposed plane on the exterior of the housing, the distal end of each terminal being located in a parallel plane, the distal end being joined to the corresponding mating section of the same terminal by an intermediate section extending between the two parallel planes, the intermediate section being insert molded in the housing.

4. The electrical connector of claim 2 wherein the distal end of each terminal insert molded in the housing includes a first mechanically formed area and a second tensilely fractured area formed when a portion of a terminal blank initially extending beyond the distal end of the terminal is removed by applying a tensile force to the portion of the blank extending beyond the distal end of the terminal.

5. The electrical connector of claim 4 wherein the plastic material covers the mechanically formed area of the distal end of the terminal with the tensilely fractured area being exposed but recessed relative to the forward end of the housing.

6. The electrical connector of claim 4 wherein the mechanically formed area is a coined area.

7. The electrical connector of claim 2 wherein the terminal extends between a rearward end and the forward end of the housing, the terminal including a termination section located adjacent the housing rearward end and a mating section located adjacent the housing forward end, a portion of the terminal between the termination section and the mating section being insert molded in the housing.

8. The electrical connector of claim 7 wherein the electrical connector comprises a plug with the mating section of each terminal being exposed for mating with the mating device, each terminal being insert molded in the housing on opposite ends of the mating section.

9. The electrical connector of claim 1 including a plurality of side by side parallel terminals, the distal ends of the terminals being parallel and extending perpendicular to the forward end of the housing.

10. The electrical connector of claim 9 wherein the electrical connector and the mating device include an exterior electrically conductive shield, the distal end of each terminal being recessed relative to the shield on the electrical connector and relative to the shield on the mating device when mated and during mating and unmating to prevent inadvertent electrical contact between the distal terminal ends and the shields.

11. An electrical connector plug comprising:

a plurality of side by side terminals, each terminal including an exposed mating surface located between a termination section and a distal end;

a nonconductive housing, insert molded around at least the distal end of each terminal, with each terminal mating surface exposed on one face of the nonconductive housing, the distal end of each terminal being recessed relative to an adjacent exterior surface of the housing; and a conductive shield extending around a portion of the housing, the shield being spaced from the mating surface of each terminal and the recessed distal end of each terminal to prevent inadvertent contact between the shield and the terminals.

12. The electrical connector of claim 11 including an overmolded section extending around the termination section of each terminal.

13. The electrical connector of claim 12 wherein the housing is insert molded around at least a portion of each terminal between the termination section and the mating surface, the insert molded terminal sections, being surrounded by plastic, between the termination section and the mating surface forming a dam when the overmolded section is formed to separate the overmolded section from the mating surface and to prevent plastic forming the overmolded section from flowing into a mating section in which the mating surface is located.

14. The electrical connector of claim 11 wherein the mating surface of each terminal includes a longitudinally extending raised surface protruding above an adjacent surface on the housing.

15. The electrical connector of claim 14 wherein a housing opening is formed below a portion of the raised surface of each terminal.

16. The electrical connector of claim 15 wherein the opening comprises a core pin opening.

17. A Universal Serial Bus plug joined to a cable, the Universal Serial Bus Plug comprising a plurality of terminal each having a distal end located adjacent to and recessed from a forward end of a nonconductive housing, the terminals being exposed on an external surface of the nonconductive housing to mate with a Universal Serial Bus receptacle, the nonconductive housing being insert molded around at least the distal end of each terminal, and an overmolded section being formed around a rearward section of the insert molded housing, a portion of the cable to which the plug is attached, and a termination section of each terminal.

18. An electrical connector matable with a mating device, the electrical connector comprising:

a molded nonconductive housing having a forward end; and at least one electrically conductive terminal extending toward the forward end of the housing and having a distal end recessed from the forward end of the housing, the distal end extending, toward the housing forward end, beyond an exposed mating surface on the terminal;

the electrical connector being characterized in that at least the distal end of the terminal is insert molded in the molded nonconductive housing with the housing separating the exposed mating surface from the forward end.

* * * * *